US009673556B2

(12) United States Patent
Kao et al.

(10) Patent No.: US 9,673,556 B2
(45) Date of Patent: Jun. 6, 2017

(54) PERPENDICULAR PLUG CONNECTOR

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Long-Fei Chen, New Taipei (TW); Yang-Yang Zhou, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/079,488

(22) Filed: Mar. 24, 2016

(65) Prior Publication Data

US 2016/0294101 A1 Oct. 6, 2016

(30) Foreign Application Priority Data

Mar. 30, 2015 (CN) ..... 2015 1 0142719

(51) Int. Cl.

| | |
|---|---|
| ***H01R 13/648*** | (2006.01) |
| ***H01R 13/502*** | (2006.01) |
| ***H01R 13/6585*** | (2011.01) |
| ***H01R 13/434*** | (2006.01) |
| ***H01R 13/73*** | (2006.01) |

(52) U.S. Cl.

CPC ..... *H01R 13/502* (2013.01); *H01R 13/434* (2013.01); *H01R 13/6585* (2013.01); *H01R 13/73* (2013.01)

(58) Field of Classification Search

CPC ..... H01R 13/6581; H01R 13/6585; H01R 13/648; H01R 13/502; H01R 24/60; H01R 24/62

USPC ..... 439/607.01, 607.32, 607.35, 660

See application file for complete search history.

(56) References Cited

U.S. PATENT DOCUMENTS

| | | | | |
|---|---|---|---|---|
| 5,603,639 | A * | 2/1997 | Lai | H01R 23/6873 439/353 |
| 9,281,626 | B2 * | 3/2016 | Lin | H01R 13/6581 |
| 2015/0364871 | A1 * | 12/2015 | Lin | H01R 13/6581 439/607.58 |
| 2016/0020537 | A1 * | 1/2016 | Ju | H01R 24/78 439/83 |
| 2016/0268741 | A1 * | 9/2016 | Tsai | H01R 13/6585 |

* cited by examiner

*Primary Examiner* — Hae Moon Hyeon

(74) *Attorney, Agent, or Firm* — Rabin & Berdo, P.C.

(57) ABSTRACT

A perpendicular plug connector has an insulative housing, multiple first conductive terminals, multiple second conductive terminals, a base, a reinforcing fastening element and a shell. The first conductive terminals and the base are mounted on the insulative housing. The reinforcing fastening element is mounted on and tightly abutting the base. The shell accommodates the insulative housing and the first conductive terminals. The reinforcing fastening element allows fasteners such as bolts and rivets to extend through and fasten the perpendicular plug connector securely on a circuit board and enhances structural strength of the base.

14 Claims, 8 Drawing Sheets

PERPENDICULAR PLUG CONNECTOR

BACKGROUND OF THE INVENTION

1. Field of the Invention

The present invention relates to a plug connector, and more particularly to a perpendicular plug connector that increases intervals between soldering sections of conductive terminals to raise the soldering rate thereof. Furthermore, a reinforcing fastening element is employed to enhance the structural strength of the fastening between the perpendicular plug connector and a circuit board.

2. Description of Related Art

Electrical connectors are general electrical components on electronic devices widely used for connecting to other matching connectors on the other electrical devices for signal transmission and power supply. A conventional universal serial bus (USB) Type C connector has an insulative housing, two sets of terminals and a metal shell. The sets of the terminals are mounted on the insulative housing for signal transmission and each terminal has a soldering section to be soldered on an external circuit board.

However, the terminals are arranged compact at excessively small intervals such that soldering the soldering sections of the terminals usually encounters issues of solder shorting due to excess solder and false soldering due to insufficient solder. Thus, soldering operation is difficult and yield rate of the connectors are lowered.

To overcome the shortcomings, the present invention provides a perpendicular plug connector to mitigate or obviate the aforementioned problems.

SUMMARY OF THE INVENTION

The main objective of the invention is to provide a perpendicular plug connector that increases intervals between soldering sections of conductive terminals to raise the soldering rate thereof. Furthermore, a reinforcing fastening element is employed to enhance the structural strength of the fastening between the perpendicular plug connector and a circuit board.

A perpendicular plug connector in accordance with the present invention comprises an insulative housing, multiple first conductive terminals, multiple second conductive terminals, a base, a reinforcing fastening element and a shell. The first conductive terminals and the base are mounted on the insulative housing. The reinforcing fastening element is mounted on and tightly abutting the base. The shell accommodates the insulative housing and the first conductive terminals. The reinforcing fastening element allows fasteners such as bolts and rivets to extend through and fasten the perpendicular plug connector securely on a circuit board and enhances structural strength of the base.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
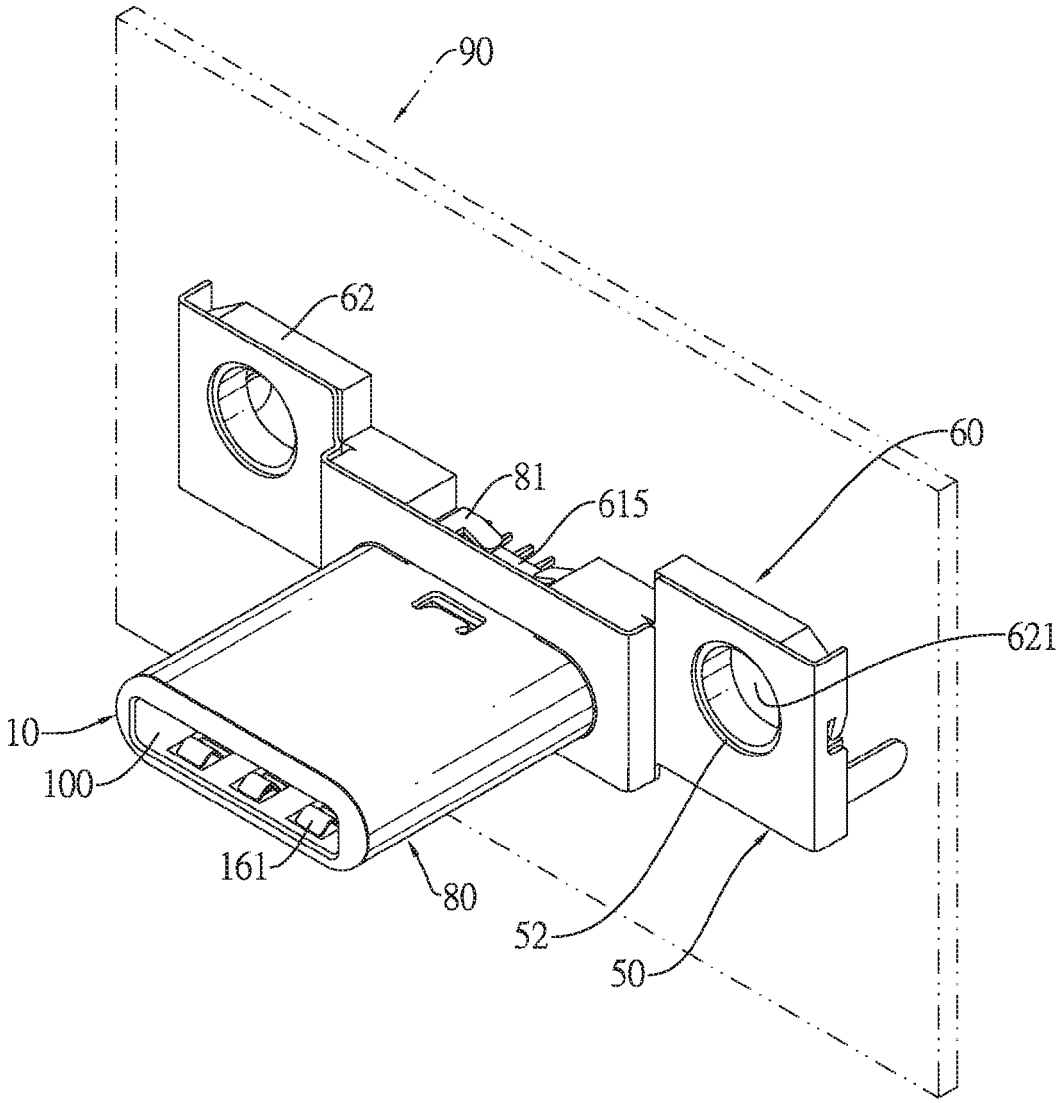
FIG. 1 is a perspective view of a perpendicular plug connector in accordance with the present invention mounted on a circuit board.
Figure 2:
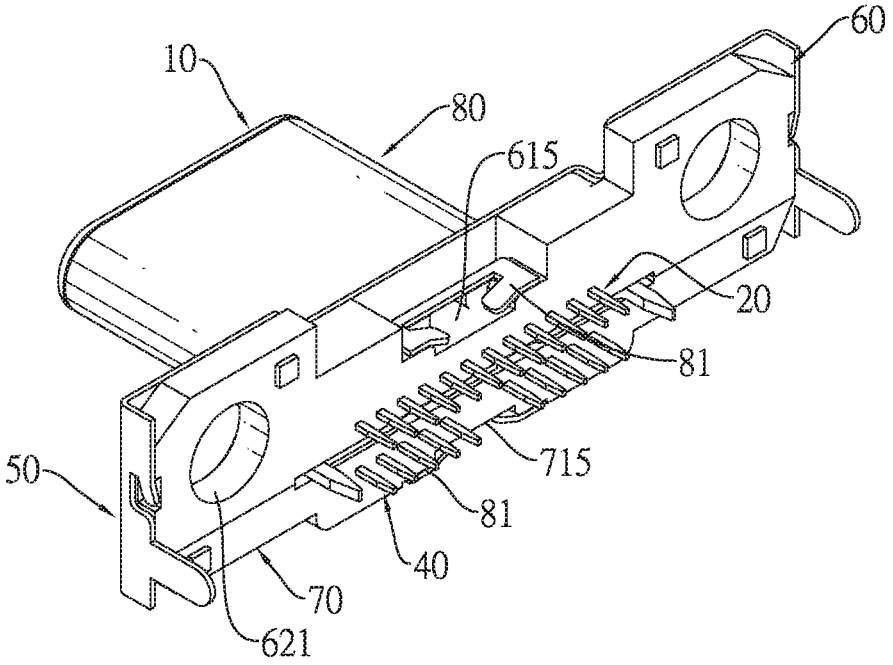
FIG. 2 is a perspective view of the perpendicular plug connector in FIG. 1.

With reference to FIGS. 1 and 2, a perpendicular plug connector in accordance with the present invention may be a USB Type-C connector, and complies with the USB Type-C Cable and Connector Specification ver. 0.98C or newer version set by the USB implementers Forum (USB IF).

Figure 3:
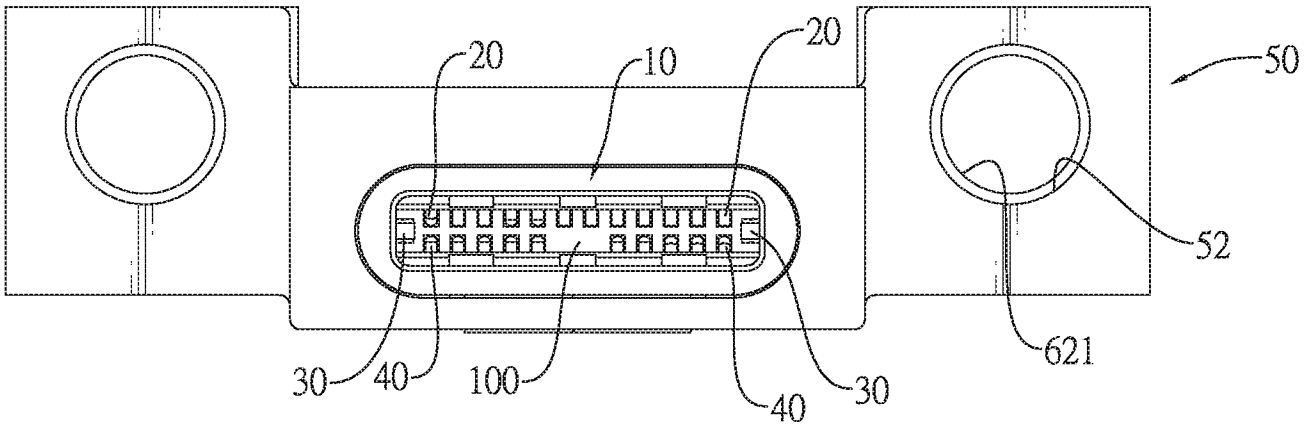
FIG. 3 is a front view of the perpendicular plug connector in FIG. 1.
Figure 4:
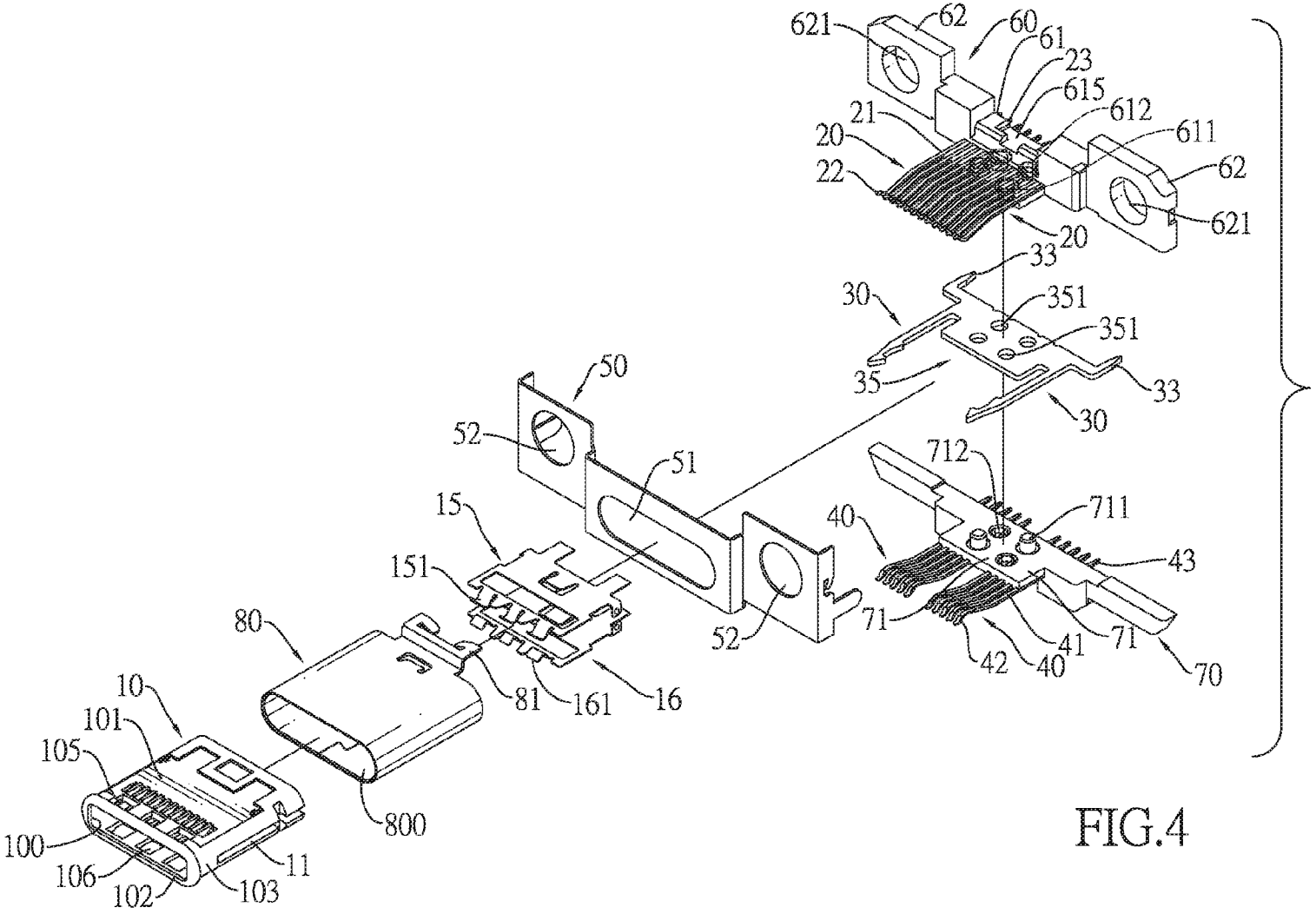
FIG. 4 is an exploded perspective view of the perpendicular plug connector in FIG. 1.

With further reference to FIGS. 3 and 4, the perpendicular plug connector may be mounted on a circuit board 90 and comprises an insulative housing 10, a first terminal set, a second terminal set, a grounding plate 35, two resilient hooking arms 30, a reinforcing fastening element 50 and a shell 80.

The insulative housing 10 has a top board 101, a bottom board 102, two opposite sidewalls 103, an insertion space 100, two positioning slots 11, an upper pressing element 15 and a lower pressing element 16.

Figure 5:
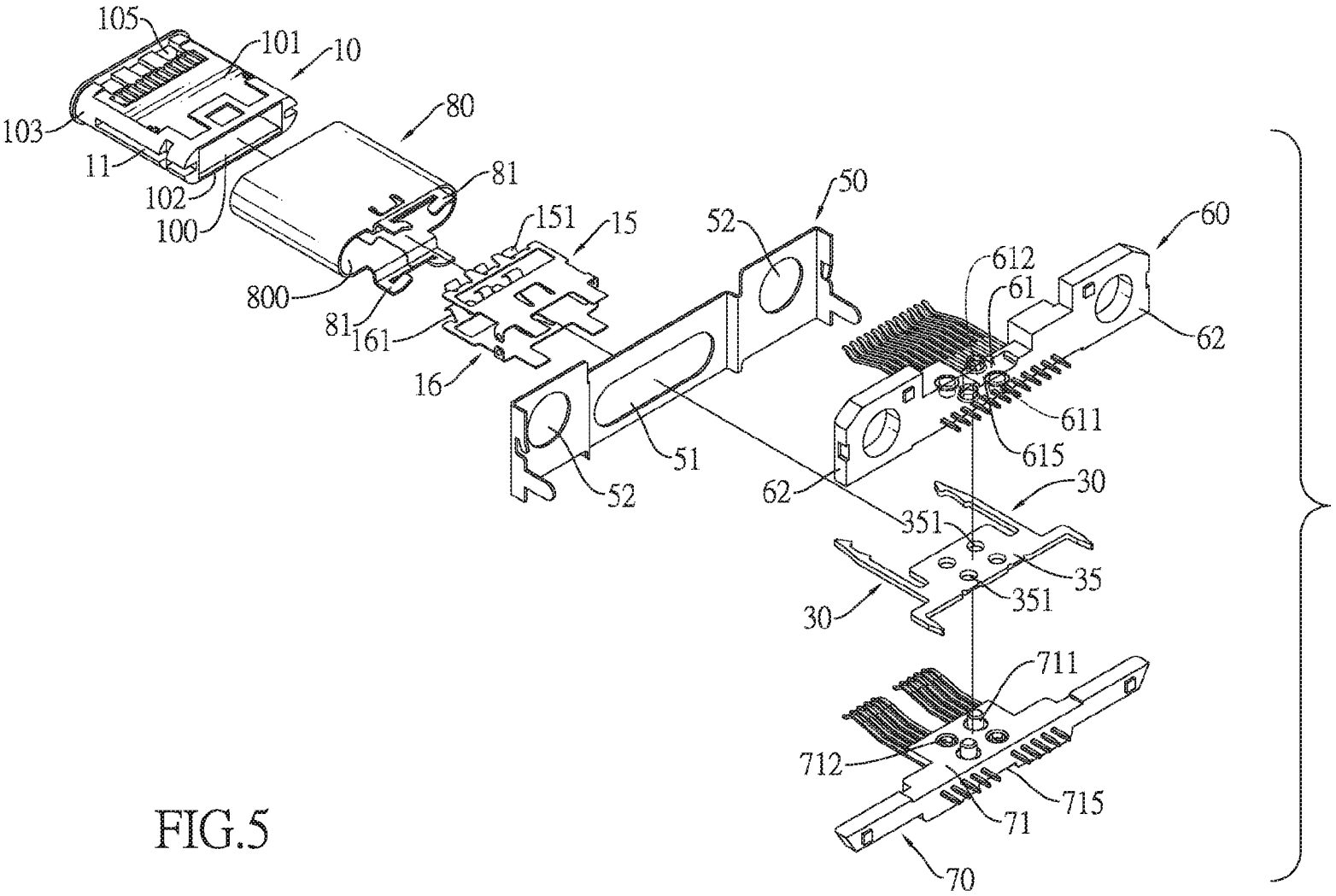
FIG. 5 is another perspective view of the perpendicular plug connector in FIG. 1.

With further reference to FIG. 5, the top board 101 has multiple upper through holes 105. The upper through holes 105 are defined through the top board 101 and communicate with the insertion space 100.

The bottom board 102 has multiple lower through holes 106. The lower through holes 106 are defined through the bottom board 102 and communicate with the insertion space 100.

The sidewalls 103 are located between the top board 101 and the bottom board 102.

The insertion space 100 is defined in a front end of the insulative housing 10 among the top board 101, the bottom board 102 and the sidewalls 103.

The positioning slots 11 are defined respectively in the sidewalls 103.

The upper pressing element 15 is mounted on the top board 101 and has multiple upper resilient pressing tabs 151 formed on the upper pressing element 15 and respectively extending through the upper through holes 105 into the insertion space 100.

The lower pressing element 16 is mounted on the bottom board 102 and has multiple lower resilient pressing tabs 161 formed on the lower pressing element 16 and respectively extending through the lower through holes 106 into the insertion space 100.

Figure 6:
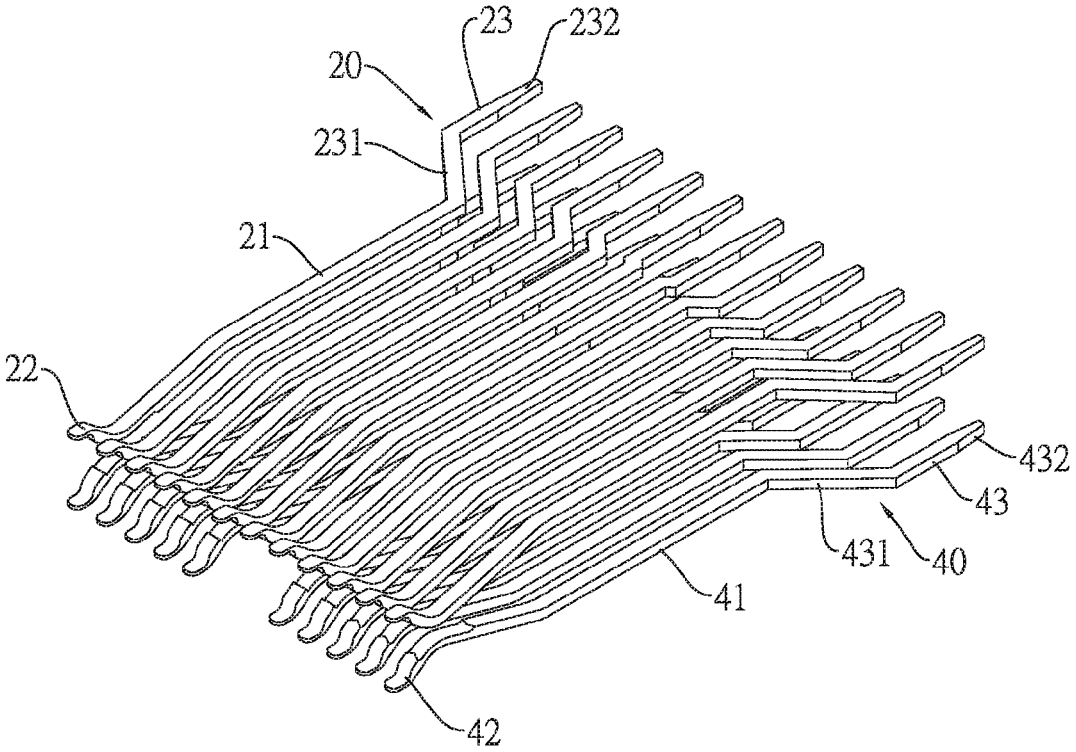
FIG. 6 is a perspective view of a first terminal set and a second terminal set of the perpendicular plug connector in FIG. 1.
Figure 7:
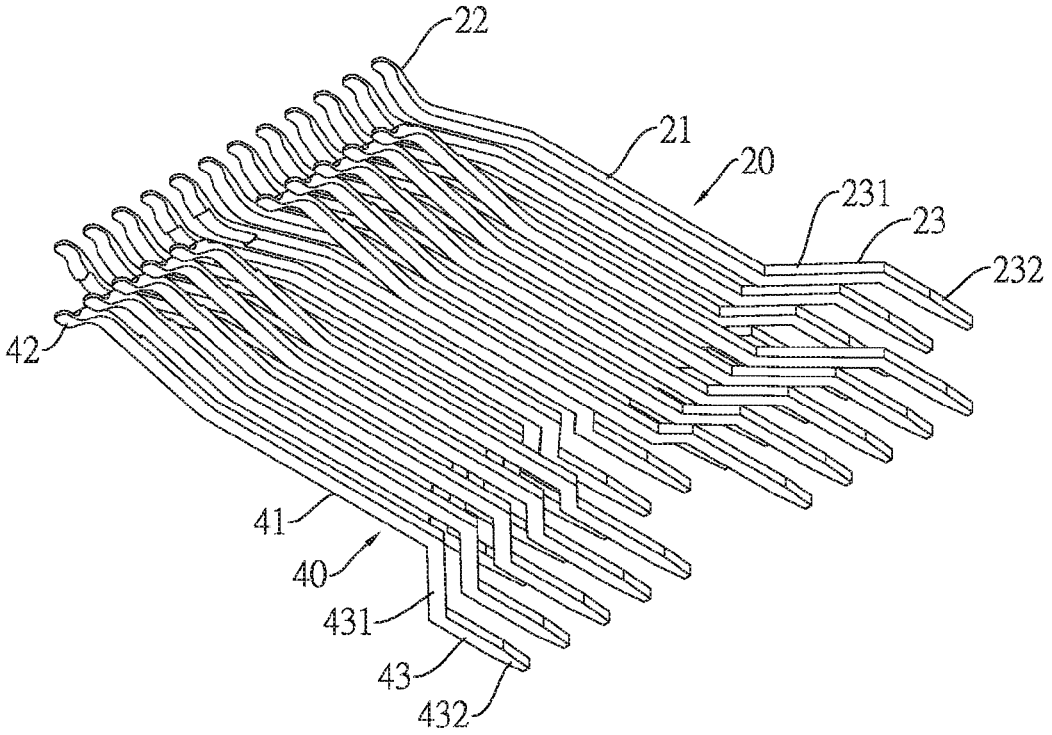
FIG. 7 is another perspective view of the first terminal set and the second terminal set of the perpendicular plug connector in FIG. 1.

With further reference to FIGS. 6 and 7, the first terminal set and the second terminal set are substantially pointing symmetrical to each other with regard to a centre of symmetry of the insertion space 100. According to pointing symmetrical configuration of the terminal sets, when the terminal sets are rotated for 180 degrees according to the centre of symmetry, the rotated terminal sets coincide with and are the same as the terminal sets without rotation of 180 degrees. By the pointing symmetrical configuration of the terminal sets, the electrical plug connector is able to extend reversely into a corresponding receptacle connector to normally implement high speed signal transmission. The first terminal set and the second terminal set are mounted respectively on the upper inner surface of the top board 101 and the lower inner surface of the bottom board 102.

The first terminal set has multiple first conductive terminals 20 mounted in the top board 101 of the insulative housing 10. Each first conductive terminal 20 has a first mounting section 21, a first electrical contacting section 22 and a first soldering section 23. The first mounting section 21 is mounted on the top board 101 of the insulative housing 10. The first electrical contacting section 22 is formed on and protrudes forward from the first mounting section 21 and extends in the insertion space 100. The first soldering section 23 is formed on and protrudes backward from the first mounting section 21. A first interval between adjacent two of the first soldering sections 23 is larger than a second interval between adjacent two of the first mounting sections 21. Furthermore, the first soldering section 23 of each first conductive terminal 20 has a first oblique extending section 231 and a first parallel section 232. The first oblique extending section 231 is formed on and protrudes obliquely outward from a rear end of the first mounting section 21. The first parallel section 232 is formed on and protrudes backward from the first oblique extending section 231 and is parallel to the first mounting section 21. The first interval, being larger than the second interval between adjacent two of the first mounting sections 21, is defined between adjacent two of the first parallel section 232.

The second terminal set has multiple second conductive terminals 40 mounted in the bottom board 102 of the insulative housing 10. Each second conductive terminal 40 has a second mounting section 41, a second electrical contacting section 42 and a second soldering section 43. The second mounting section 41 is mounted on the bottom board 102 of the insulative housing 10. The second electrical contacting section 42 is formed on and protrudes forward from the second mounting section 41 and extends in the insertion space 100. The second soldering section 43 is formed on and protrudes backward from the second mounting section 41. A third interval between adjacent two of the second soldering sections 43 is larger than a fourth interval between adjacent two of the second mounting sections 41. Furthermore, the second soldering section 43 of each second conductive terminal 40 has a second oblique extending section 431 and a second parallel section 432. The second oblique extending section 431 is formed on and protrudes obliquely outward from a rear end of the second mounting section 41. The second parallel section 432 is formed on and protrudes backward from the second oblique extending section 431 and is parallel to the second mounting section 41. The third interval, being larger than the fourth interval between adjacent two of the second mounting sections 41, is defined between adjacent two of the second parallel section 432.

Figure 8:
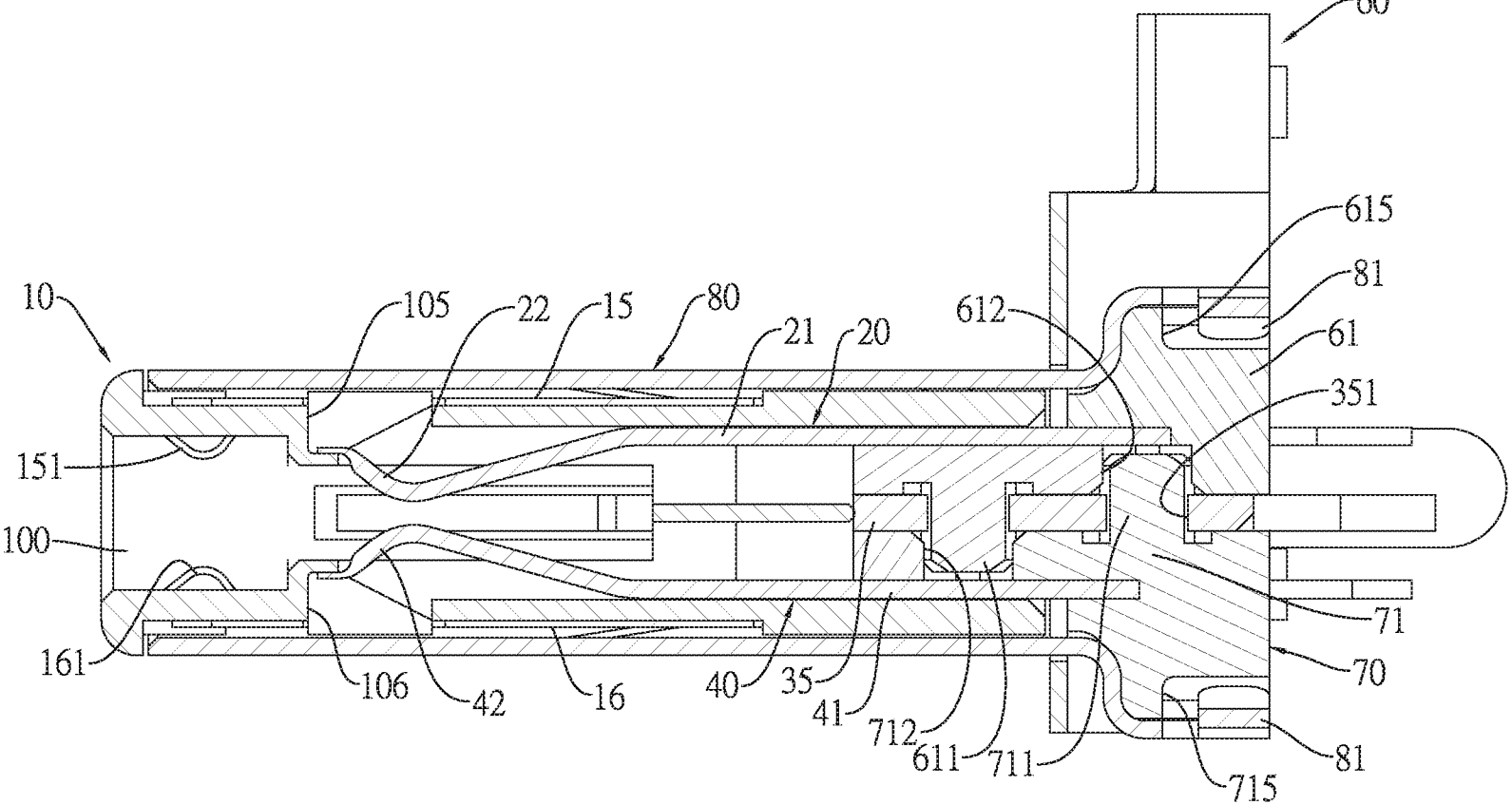
FIG. 8 is a cross sectional side view of the perpendicular plug connector in FIG. 1.

With further reference to FIG. 8, the grounding plate 35 is disposed between the first terminal set and the second terminal set and has multiple through holes 351 defined through the grounding plate 35.

The resilient hooking arms 30 are formed respectively on two opposite sides of the grounding plate 35, are mounted in the insulative housing 10, extend in the insertion space 100 and may be mounted respectively in the positioning slots 11. Each resilient hooking arm 30 has a grounding soldering leg 33 formed on and protruding backward from the resilient hooking arm 30 and soldered on the circuit board 90 to provide a grounding function.

The base is mounted on a rear end of the insulative housing 10, extends in the internal space 100 and has an upper base member 60 and a lower base member 70.

The upper base member 60 is mounted in the rear end of the insulative housing 10, is disposed above the grounding plate 35 and has an upper plug bracket 61 and two upper wings 62.

The upper plug bracket 61 is mounted in the insertion space 100 and has an upper embedding slot 615, multiple upper mounting protrusions 611 and multiple upper mounting holes 612. The upper embedding slot 615 is defined in the upper plug bracket 61. The upper mounting protrusions 611 are formed on and protrude downward from the upper plug bracket 61 and respectively extend through some of the through holes 351 of the grounding plate 35. The upper mounting holes 612 are defined in the upper plug bracket 61.

The wings 62 are formed on two opposite sides of the upper plug bracket 61 and each wing 62 has a fastening holes 621 defined through the wing 62.

The lower base member 70 is mounted on the rear end of the insulative housing 10, is disposed under the grounding plate 35 and has a lower plug bracket 71. The lower plug bracket 71 is mounted in the internal space 100, is engaged with the upper plug bracket 61 and has a lower embedding slot 715, multiple lower protrusions 711 and multiple lower mounting holes 712. The lower embedding slot 715 is defined in the lower plug bracket 71. The lower protrusions 711 are formed on and protrude upward from the lower plug bracket 71, respectively extend through some of the through holes 351 of the grounding plate 35 and are mounted respectively in the upper mounting holes 612. The lower mounting holes 712 are defined in the lower plug bracket 71 and respectively receive the upper mounting protrusions 611.

The reinforcing fastening element 50 is made of metal, is mounted on and tightly abuts the base, is mounted around the upper plug bracket 60 and the lower plug bracket 71 and has a mounting opening 51, two assembling holes 52.

The mounting opening 51 is defined through the reinforcing fastening element 50 and is mounted around the upper plug bracket 60 and the lower plug bracket 71.

The assembling holes 52 are defined through the reinforcing fastening element 50 and are aligned respectively with the fastening holes 621 of the upper base member 60. The assembling holes 52 and the fastening holes 621 may accommodate fasteners such as screws or rivets to fasten the perpendicular plug connector securely on the circuit board 90. Furthermore, the reinforcing fastening element 50 tightly abuts the upper base member 60 and increases the structural strength of the upper base member 60.

The shell 80 has a cavity 800 and two embedding tabs 81. The cavity 800 is defined through the shell 80 and accommodates the insulative housing 10, the first terminal set and the second terminal set. The embedding tabs 81 are formed on a rear end of the shell 80 and are respectively embedded in the upper embedding slot 615 and the lower embedding slot 715.

The perpendicular plug connector in accordance with the present invention has the following advantages.

1. The enlarged first interval between adjacent first soldering sections 23 and the enlarged third interval between adjacent second soldering sections 43 allow more solder capacity and tolerance during a soldering process, which increase the soldering rate and reduces issues of excess solder and false soldering.

2. The wings 62 of the upper base member 60 and the reinforcing fastening element 50 allow fasteners such as bolts and rivets to extend through and fasten the perpendicular plug connector securely on the circuit board 90. A firm engagement between the perpendicular plug connector and the circuit board 90 are therefore achieve by the upper base member 60 and the reinforcing fastening element 50 to prevent any inadvertent disassembly issue.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A plug connector comprising:

an insulative housing having a top board, a bottom board, two opposite sidewalls and an insertion space defined in a front end of the insulative housing among the top board, the bottom board and the sidewalls;

a first terminal set mounted on the upper inner surface of the top board of the insulative housing and having multiple first conductive terminals, and each first conductive terminal having a first mounting section mounted on the top board of the insulative housing;

a first electrical contacting section formed on and protruding forward from the first mounting section and extending in the insertion space; and a first soldering section is formed on and protruding backward from the first mounting section;

a base mounted on a rear end of the insulative housing and extending in the internal space;

a reinforcing fastening element mounted on and tightly abutting the base; and a shell having a cavity defined through the shell and accommodating the insulative housing and the first terminal set;

wherein the base has an upper base member mounted in the rear end of the insulative housing and having an upper plug bracket mounted in the insertion space; and two upper wings formed on two opposite sides of the upper plug bracket and each wing having a fastening hole defined through the wing; and a lower base member mounted on the rear end of the insulative housing and having a lower plug bracket mounted in the internal space, engaged with the upper plug bracket; and wherein the reinforcing fastening element is mounted around the upper plug bracket and the lower plug bracket.

2. The plug connector as claimed in claim 1 further comprising a second terminal set;

wherein the first terminal set and the second terminal set are substantially pointing symmetrical to each other with regard to a centre of symmetry of the insertion space, and the second terminal set has multiple second conductive terminals mounted in the bottom board of the insulative housing and each second conductive terminal having a second mounting section mounted on the bottom board of the insulative housing;

a second electrical contacting section formed on and protruding forward from the second mounting section and extends in the insertion space; and a second soldering section formed on and protruding backward from the second mounting section.

3. The plug connector as claimed in claim 2, wherein a first interval between adjacent two of the first soldering sections is larger than a second interval between adjacent two of the first mounting sections; and a third interval between adjacent two of the second soldering sections is larger than a fourth interval between adjacent two of the second mounting sections.

4. The plug connector as claimed in claim 3 further comprising a grounding plate disposed between the first terminal set and the second terminal set and disposed between the upper base member and the lower base member.

5. The plug connector as claimed in claim 4, wherein the first soldering section of each first conductive terminal has a first oblique extending section formed on and protruding obliquely outward from a rear end of the first mounting section; and a first parallel section formed on and protruding backward from the first oblique extending section and being parallel to the first mounting section;

the first interval, being larger than the second interval between adjacent two of the first mounting sections, is defined between adjacent two of the first parallel section;

the second soldering section of each second conductive terminal has a second oblique extending section formed on and protruding obliquely outward from a rear end of the second mounting section; and a second parallel section formed on and protruding backward from the second oblique extending section and being parallel to the second mounting section; and the third interval, being larger than the fourth interval between adjacent two of the second mounting sections, is defined between adjacent two of the second parallel section.

6. The plug connector as claimed in claim 5, wherein the reinforcing fastening element has a mounting opening defined through the reinforcing fastening element and mounted around the upper plug bracket and the lower plug bracket.

7. The plug connector as claimed in claim 6, wherein the grounding plate has multiple through holes defined through the grounding plate;

the upper plug bracket has multiple upper mounting protrusions formed on and protruding downward from the upper plug bracket and respectively extending through some of the through holes of the grounding plate; and multiple upper mounting holes defined in the upper plug bracket;

the lower bracket has multiple lower mounting protrusion formed on and protruding upward from the lower plug bracket, respectively extending through some of the through holes of the grounding plate and mounted respectively in the upper mounting holes; and multiple lower mounting holes defined in the lower plug bracket and respectively receiving the upper mounting protrusions.

8. The plug connector as claimed in claim 7 further comprising two resilient hooking arms formed respectively on two and extending in the insertion space.

9. The plug connector as claimed in claim 8, wherein each resilient hooking arm has a grounding soldering leg formed on and protruding backward from the resilient hooking arm.

10. The plug connector as claimed in claim 9, wherein the upper plug bracket has an upper embedding slot defined in the upper plug bracket;

the lower plug bracket has a lower embedding slot defined in the lower plug bracket; and the shell further has two embedding tabs formed on a rear end of the shell and are respectively embedded in the upper embedding slot and the lower embedding slot.

11. The plug connector as claimed in claim 10, wherein the top board has multiple upper through holes defined through the top board and communicating with the insertion space;

an upper pressing element is mounted on the top board and has multiple upper resilient pressing tabs formed on the upper pressing element and respectively extending through the upper through holes into the insertion space;

the bottom board multiple lower through holes defined through the bottom board and communicating with the insertion space; and a lower pressing element is mounted on the bottom board and has multiple lower resilient pressing tabs formed on the lower pressing element and respectively extending through the lower through holes into the insertion space.

12. The plug connector as claimed in claim 11, wherein two positioning slots are defined respectively in the sidewalls of the insulative housing; and the resilient hooking arms are mounted respectively in the positioning slots.

13. The plug connector as claimed in claim 12, wherein the reinforcing fastening element is made of metal.

14. The plug connector as claimed in claim 13, wherein the plug connector is a perpendicular plug connector.

* * * * *